US006425382B1

(12) United States Patent
Marthaler et al.

(10) Patent No.: US 6,425,382 B1
(45) Date of Patent: Jul. 30, 2002

(54) AIR-EXHAUST MIXER ASSEMBLY

(75) Inventors: Michael J. Marthaler; Gregory H. Henderson, both of Columbus, IN (US)

(73) Assignee: Cummins Engine Company, Inc., Columbus, IN (US)

( * ) Notice: Subject to any disclaimer, the term of this patent is extended or adjusted under 35 U.S.C. 154(b) by 5 days.

(21) Appl. No.: 09/757,220

(22) Filed: Jan. 9, 2001

(51) Int. Cl.[7] ..... F02M 25/07
(52) U.S. Cl. ..... 123/568.17
(58) Field of Search ..... 123/568.17; 60/605.2

(56) References Cited

U.S. PATENT DOCUMENTS

| | | | | | |
|---|---|---|---|---|---|
| 3,712,281 | A | | 1/1973 | Ruth | |
| 3,890,945 | A | * | 6/1975 | Goto et al. | 123/568.17 |
| 4,011,846 | A | | 3/1977 | Gagliardi | |
| 4,066,052 | A | | 1/1978 | Moore et al. | |
| 4,092,959 | A | * | 6/1978 | Maxer | 123/568.17 |
| 4,114,370 | A | | 9/1978 | Woods | 60/279 |
| 4,393,853 | A | | 7/1983 | Groves | 123/568.11 |
| 4,609,342 | A | | 9/1986 | Showalter | 431/2 |
| 5,494,020 | A | | 2/1996 | Meng | 123/568.11 |
| 5,533,487 | A | * | 7/1996 | Cailey | 123/568.17 |
| 5,937,650 | A | * | 8/1999 | Arnold | 60/605.2 |
| 6,089,212 | A | * | 7/2000 | Plock et al. | 123/568.17 |
| 6,267,106 | B1 | * | 7/2001 | Feucht | 123/568.17 |
| 6,343,594 | B1 | * | 2/2002 | Koeslin et al. | 123/568.17 |

* cited by examiner

*Primary Examiner*—Paul J. Hirsch
(74) *Attorney, Agent, or Firm*—Woodard, Emhardt, Naughton, Moriarty & McNett

(57) ABSTRACT

An air-exhaust mixer assembly includes an air intake to supply air and an exhaust gas intake to supply exhaust gas. A mixer is fluidly coupled to the air intake and the exhaust gas intake. The mixer has an inner passage and an outer passage defined therein along a longitudinal axis. The inner passage and the outer passage are adapted to mix the air and the exhaust gas by expanding the air and the exhaust gas in radially opposite directions with respect to the longitudinal axis.

20 Claims, 7 Drawing Sheets

AIR-EXHAUST MIXER ASSEMBLY

BACKGROUND OF THE INVENTION

The present invention generally relates to air-exhaust mixer assemblies, and more specifically, but not exclusively, concerns a compact air-exhaust mixer assembly that minimizes the number of required modifications for installation to preexisting air/exhaust plumbing.

Exhaust gas recirculation (EGR) is used to reduce pollution generated by engines and other combustion devices. With EGR, a portion of the exhaust gas generated by the engine is mixed into the air intake in order to reduce the amount of pollutants expelled into the atmosphere. Typical air-exhaust mixer assemblies, such as venturi type mixers, occupy a large amount of space so as to ensure that the exhaust gas and intake air are completely mixed. Incomplete mixing of the air and exhaust gases can lead to the creation of increased concentrations of pollutants in the exhaust gas. To ensure complete mixing of the gases, venturi type mixers typically have long mixing cavities. Other types of mixers have mixing cavities with large lengths, widths and/or heights in order ensure complete mixing of the gases. These large mixers in turn makes retrofitting of air-exhaust mixers to engines quite expensive, because the plumbing of the engine has to be extensively modified in order to accommodate the large air-exhaust mixers. Another problem is that venturi type mixers significantly reduce the pressure of the mixed gas supplied to the engine. Therefore, there has been a long felt need for a compact air-exhaust mixer that is relatively inexpensive to manufacture and install, and that minimizes gas pressure drop across the mixer.

SUMMARY OF THE INVENTION

An air-exhaust mixer assembly includes an air intake to supply air and an exhaust gas intake to supply exhaust gas. A mixer is fluidly coupled to the air intake and the exhaust gas intake. The mixer has an inner passage and an outer passage defined therein along a longitudinal axis. The inner passage and the outer passage are constructed and arranged to deliver the air and the exhaust gas ready for mixing by expanding the air and exhaust gas in radially opposite directions with respect to the longitudinal axis.

DESCRIPTION OF SELECTED EMBODIMENTS

Figure 1:
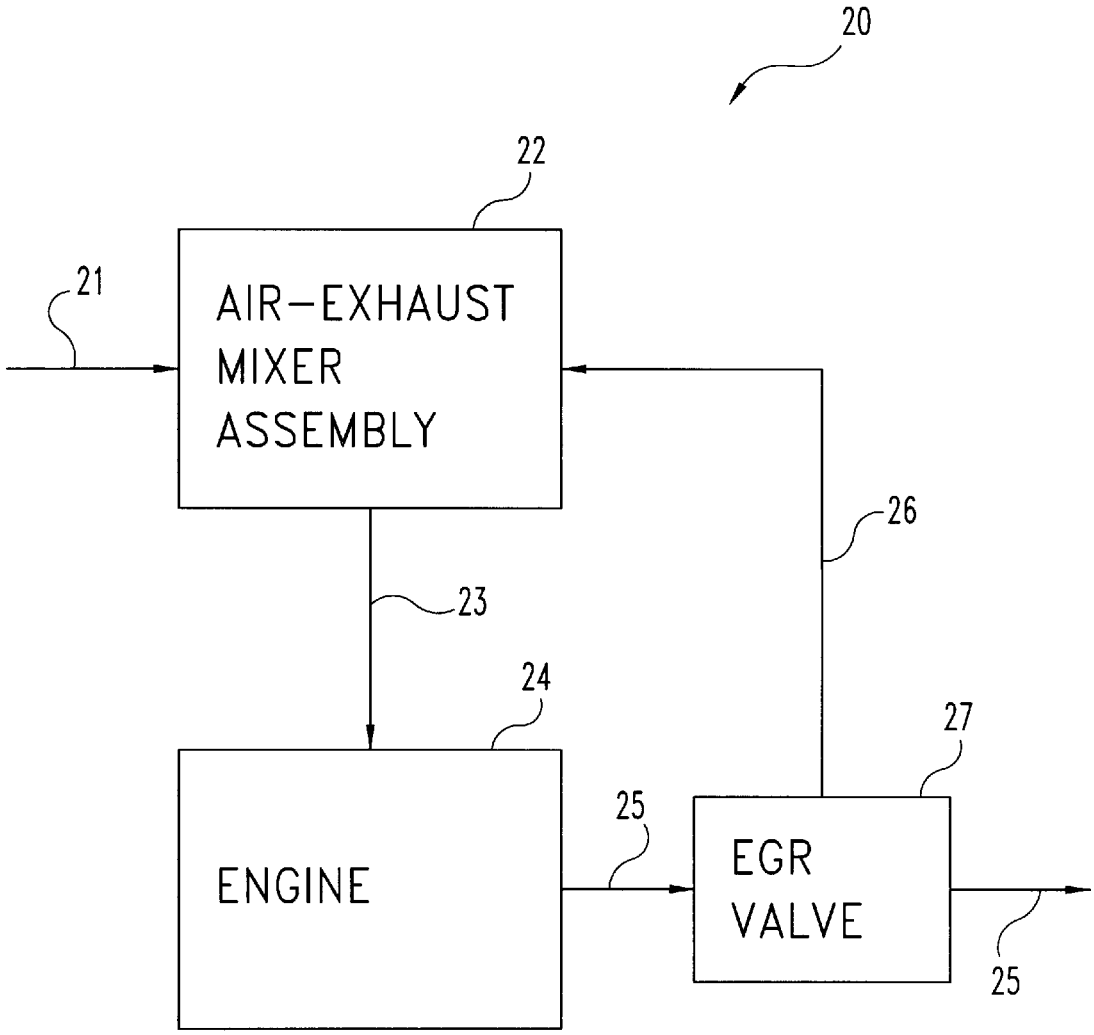
FIG. 1 is a block diagram of an air exchange system according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as described herein being contemplated as would normally occur to one skilled in the art to which the invention relates. One embodiment of the invention is shown in great detail, although it will be apparent to those skilled in the art that some of the features which are not relevant to the invention may not be shown for the sake of clarity.

Referring now to FIG. 1, a mixer-engine system 20 according to one embodiment of the present invention is illustrated in diagrammatic form. System 20 includes an air intake 21, an air-exhaust mixer assembly 22, a mixed air-exhaust gas conduit 23, an engine 24, an exhaust conduit 25, an exhaust gas intake 26, and an EGR valve 27 located between two sections of exhaust conduit 25. As illustrated, the air intake 21 and the exhaust gas intake 26 are fluidly coupled to the air-exhaust mixer assembly 22. Through the mixed air-exhaust gas conduit 23, the air-exhaust mixer 22 is fluidly coupled to the engine 24. The engine 24 is fluidly coupled to the EGR valve 27 through the exhaust conduit 25, and the EGR valve 27 is fluidly coupled to the air-exhaust mixer assembly 22 through the exhaust gas intake 26.

With system 20, air is supplied through air intake 21. It should be appreciated that the supplied air can be filtered, unfiltered, and/or be supplied in other manners as generally known by those skilled in the art. In one embodiment, pressurized air is sent through an air cooler (not illustrated) before being sent to the air intake 21. The EGR valve 27 recirculates a portion of exhaust gas exhausted from the engine 24 into the air-exhaust mixer assembly 22, and the remaining exhaust gas is exhausted out the exhaust conduit 25. The recirculated exhaust gas along with the air is mixed in the air-exhaust mixer assembly 22. The mixed air-exhaust gas is then supplied to the engine 24 through the mixed air-exhaust gas conduit 23. In one particular embodiment, the engine 24 is a diesel engine. It should be appreciated that the air-exhaust mixer assembly 22 according to the present invention can be used on other types of combustion devices as would generally occur to those skilled in the art.

Figure 2:
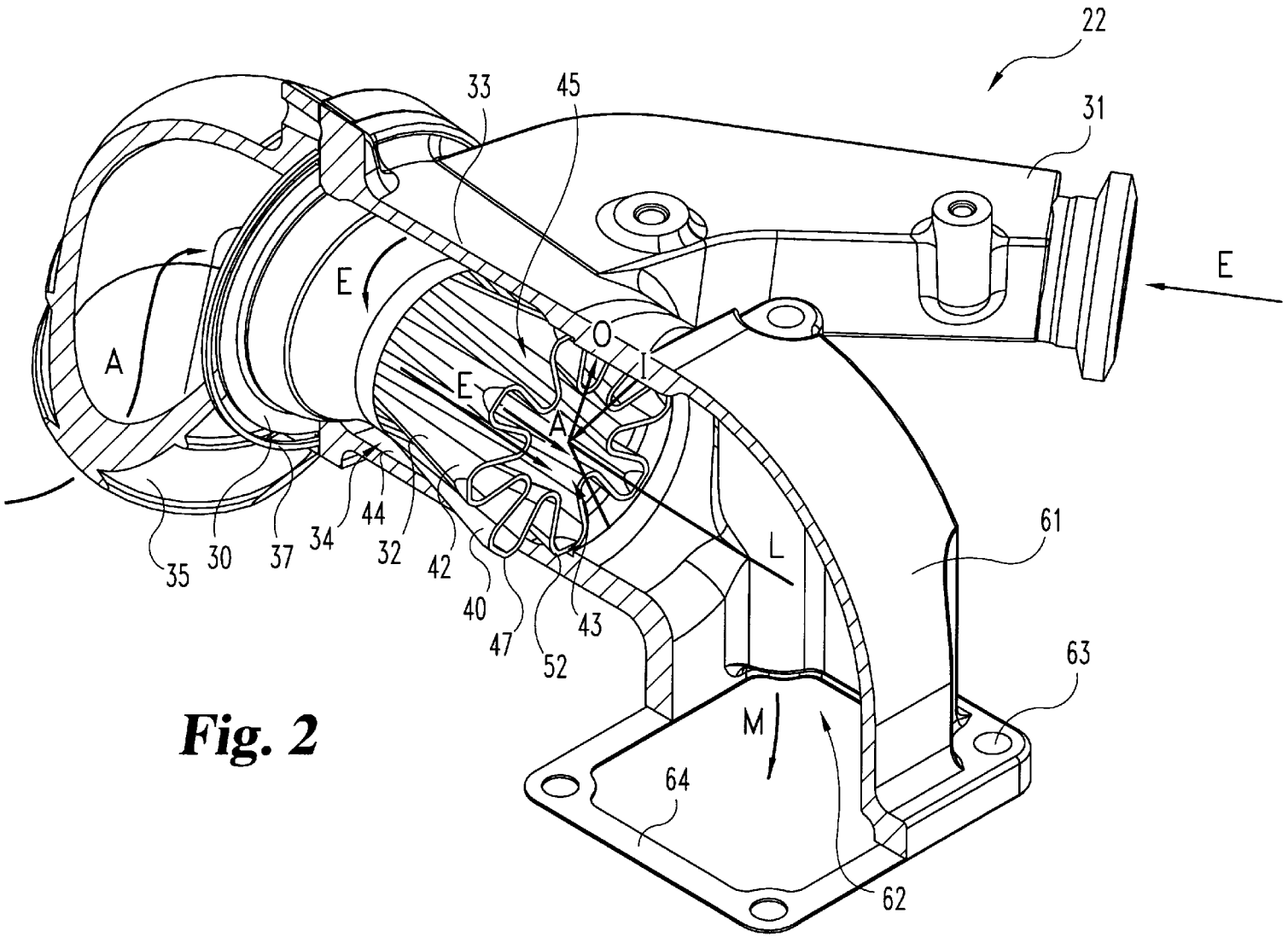
FIG. 2 is a front perspective view in partial cross-section of an air-exhaust mixer assembly according to one embodiment of the present invention.
Figure 3:
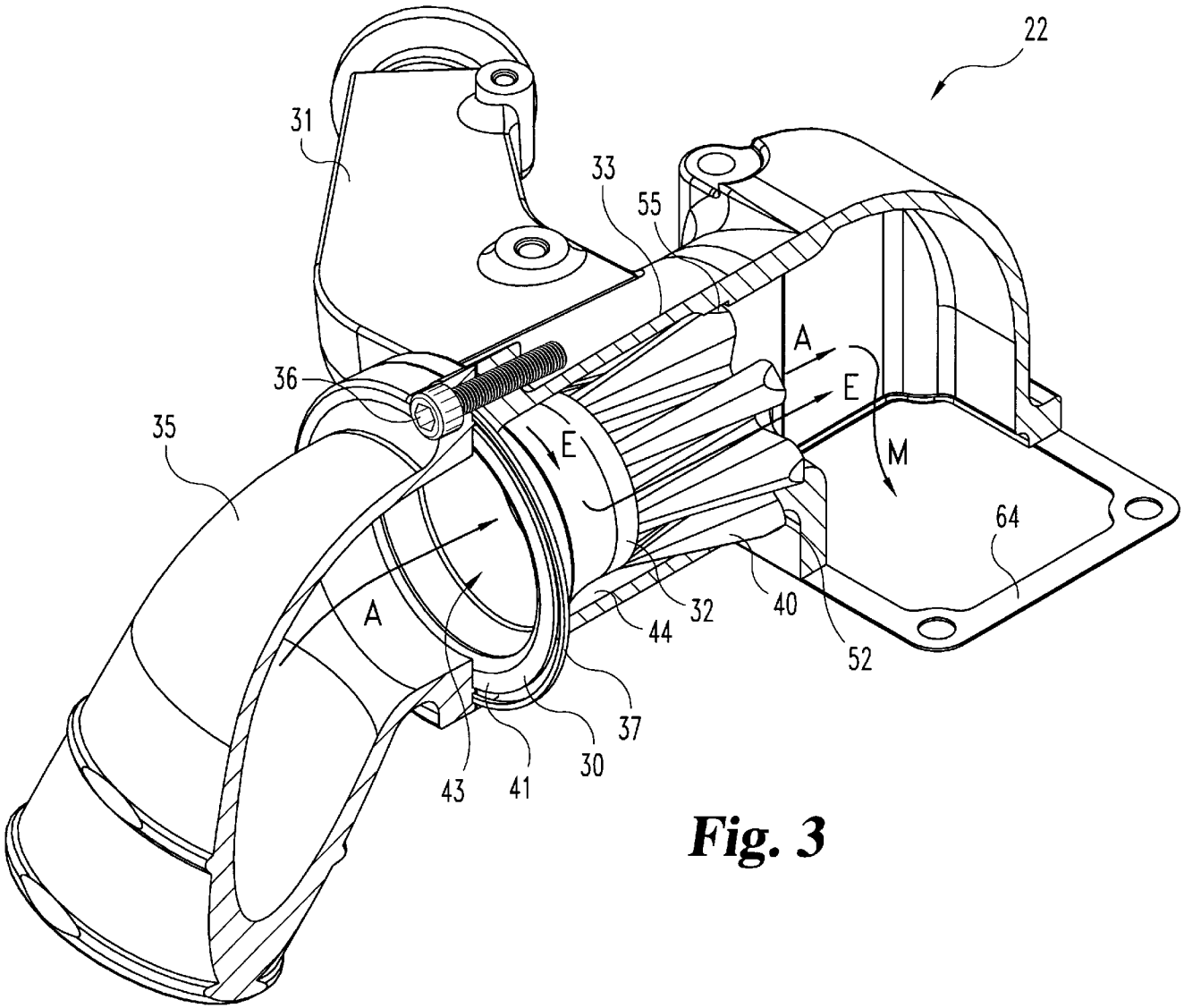
FIG. 3 is a rear perspective view in partial cross-section of the air-exhaust mixer assembly of FIG. 2.

The air-exhaust mixer assembly 22 according to one embodiment of the present invention will now be described with reference to FIGS. 2–6. As illustrated in FIG. 2, the air-exhaust mixer assembly 22 includes an air intake portion 30, an exhaust gas intake 31, a mixer 32, and a mixer housing 33. The mixer housing 33 has a mixer cavity 34 defined therein, and the mixer 32 is received in the mixer cavity 34. During assembly, the mixer 32 is slided into position in the mixer cavity 34 and then fixed in a manner as described below. An intake connection elbow 35 is fluidly coupled to the air intake portion 30 by securing the connection elbow 35 to the mixer housing 33 with at least one cap screw 36 (FIG. 3). In one particular embodiment, three cap screws 36 secure the connection elbow 35 to the mixer housing 33. It should be appreciated that the connection elbow 35 can be secured to the mixer housing 33 in other manners as generally known by those skilled in the art. A seal 37 is provided between the air intake portion 30 and the connection elbow 35 in order to seal the connection. In one embodiment, the seal 37 is an elastomeric o-ring seal.

Figure 6:
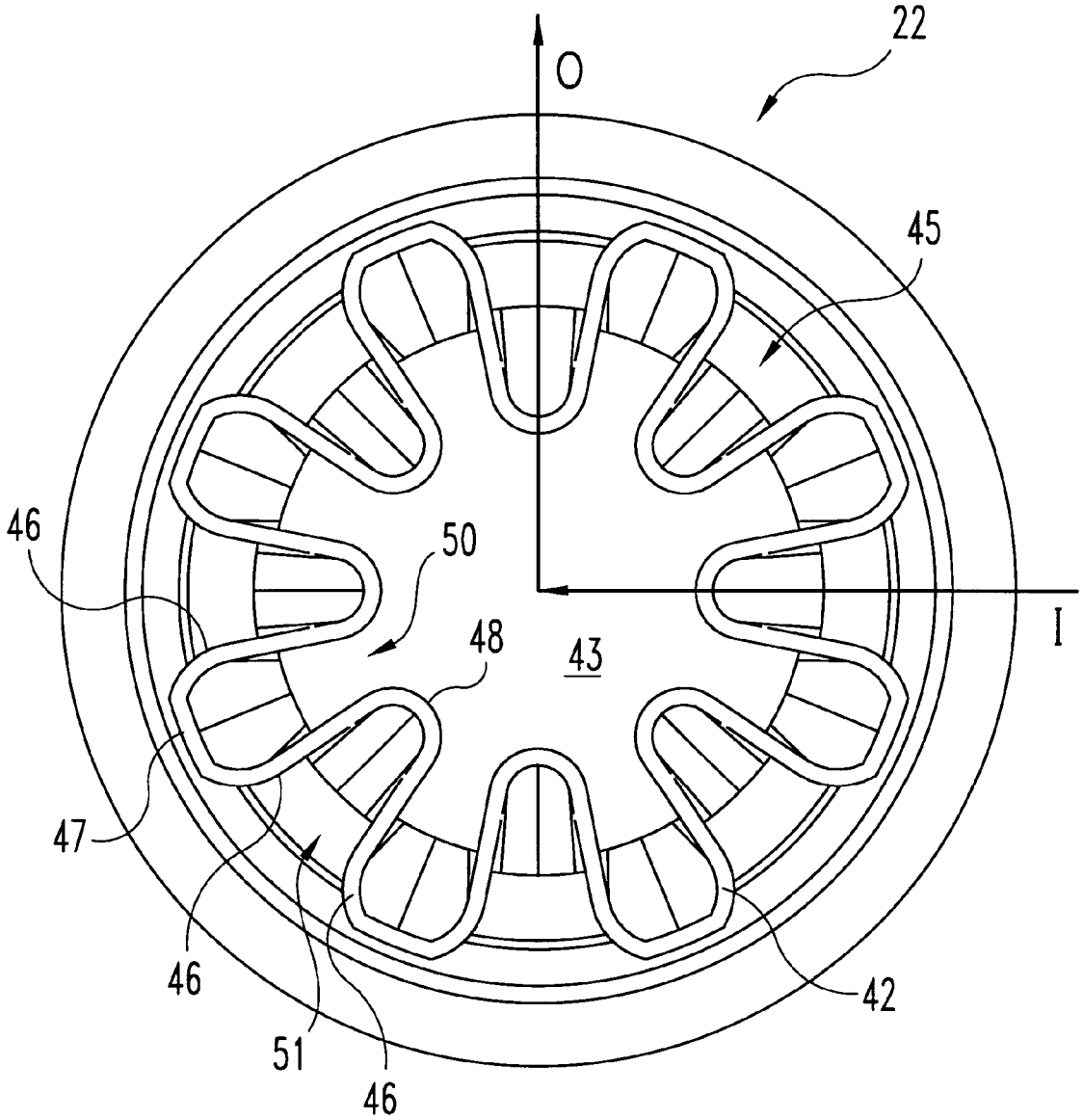
FIG. 6 is a front elevational view of the mixer included as part of the FIG. 2 air-exhaust mixer assembly.

The air intake portion 30 has a generally frustoconical shape that inwardly tapers from the connection elbow 35 downstream towards a mixer portion 40 of the mixer 32. The air intake portion 30 of the mixer 32 has an annular lip 41 abutting the connection elbow 35, and the annular lip 41 ensures that the mixer 32 is properly secured in the cavity 34. The annular mixer portion 40 has corrugated walls 42. The corrugated walls 42 and the intake portion 30 have an inner passage 43 defined therein. The mixer 32 has a central longitudinal axis L that extends through the inner passage 43. Mixer cavity wall 44 of the mixer housing 33, the intake portion 30 and the corrugated walls 42 of the mixer 32 define an outer passage 45. As shown in FIG. 6, the corrugated walls 42 include radial sidewall portions 46, radial outer wall portions 47, and radial inner wall portions 48. The radial sidewall portions 46 along with the radial outer wall portions 47 define a plurality of inner mixer channels 50, and the radial sidewall portions 46 along with the radial inner wall portions 48 define a plurality of outer mixer channels 51.

Figure 7:
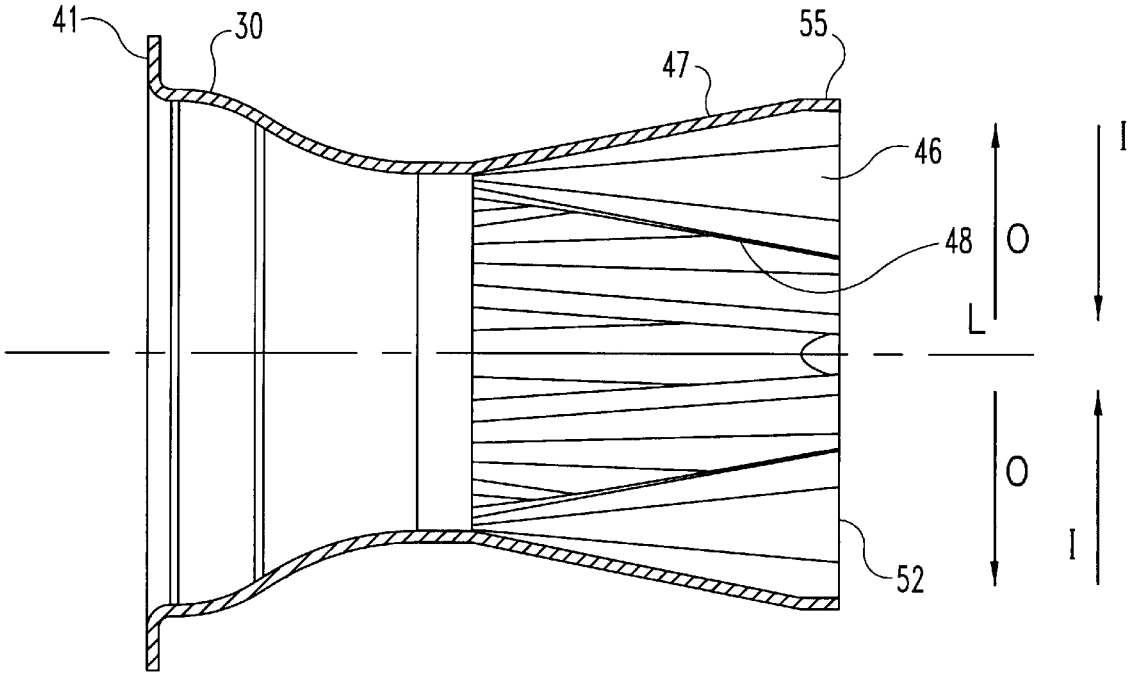
FIG. 7 is a side elevational view in full cross-section of the mixer shown in FIG. 6.

As illustrated in FIG. 7, the radial sidewall portions 46 radially expand with respect to the longitudinal axis from the air intake portion 30 to a downstream portion 52 of the mixer 32. As shown, the outer wall portions 47 are angled along the longitudinal axis L in a radially outward direction O from the air intake portion 30 to the downstream portion 52. In comparison, the inner wall portions 48 are angled along the longitudinal axis L in a radially inward direction I from the air intake portion 30 to the downstream portion 52. Consequently, the inner mixer channels 50 generally expand in the radially outward direction O from the air intake portion 30, and the outer mixer channels 51 generally expand in the radially inward direction I from the air intake portion 30. In one embodiment, the cross-sectional areas of both the inner passage 43 and the outer passage 45 along the mixer portion 40 remain constant so as to minimize pressure drop in the mixer assembly 22.

Figure 4:
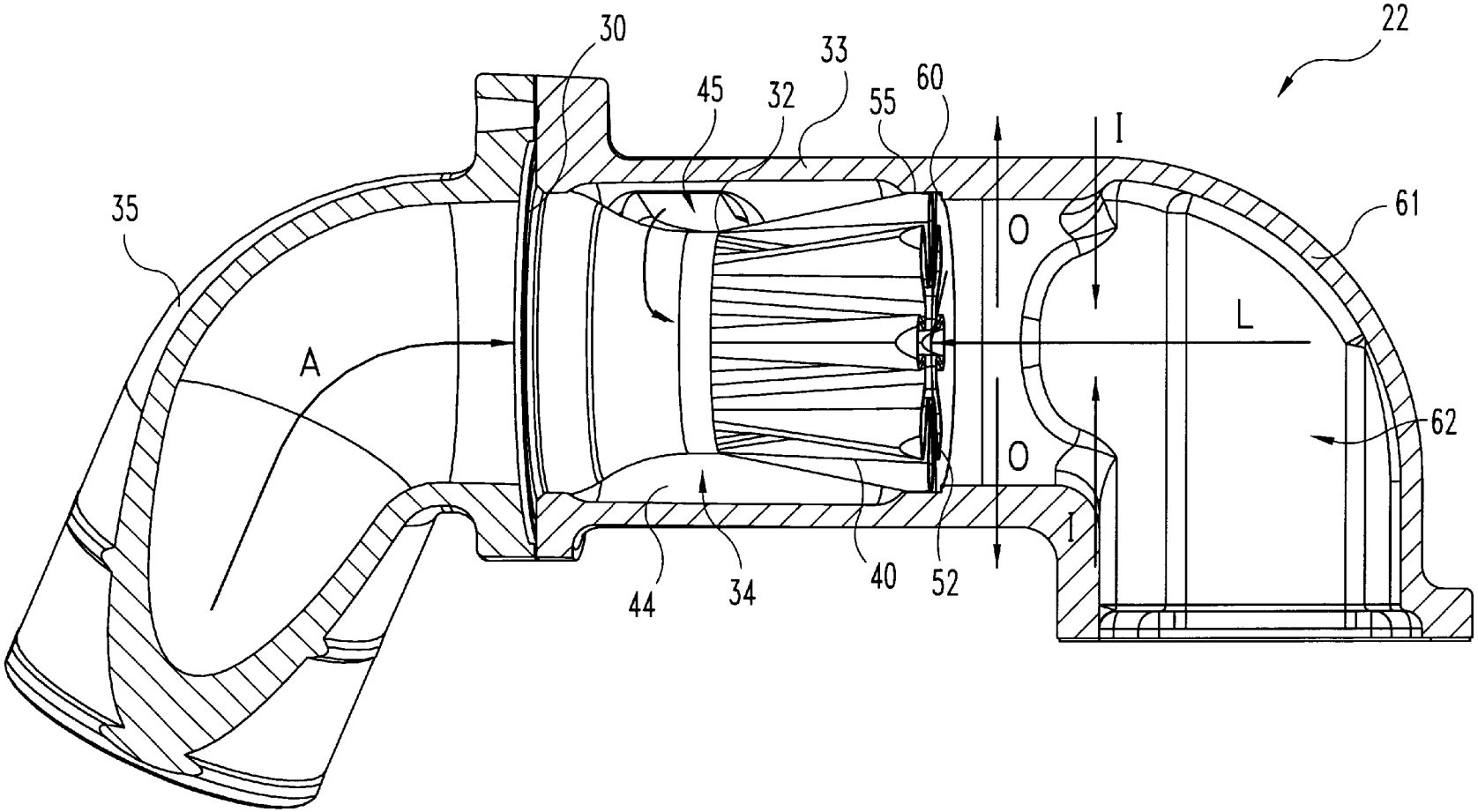
FIG. 4 is a side elevational view in partial cross-section of the air-exhaust mixer assembly of FIG. 2.
Figure 5:
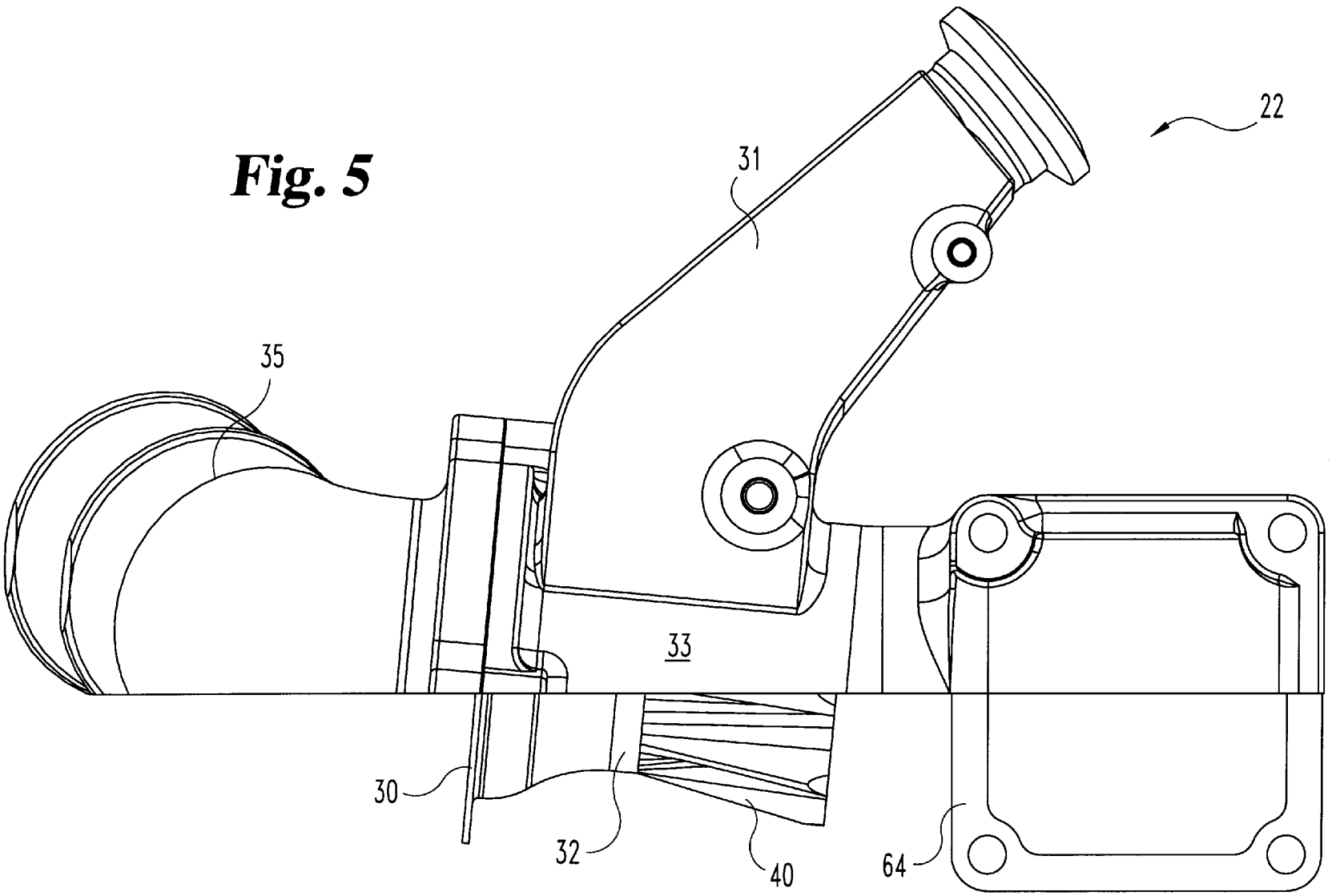
FIG. 5 is a top plan view in partial cross-section of the air-exhaust mixer assembly corresponding to the FIG. 2 view.

Referring to FIGS. 3–4, the corrugated walls 42 further have flat end portions 55 defined on the downstream portion 52 of the mixer 32. These flat portions 55, as illustrated in FIG. 4, engage the inner surface 44 of the mixer cavity 34 at lip portion 60. The connection elbow 35 is fluidly coupled to the inner passage 43 of the mixer 32, and the exhaust gas intake 31 is fluidly coupled to the outer passage 45 of the air-exhaust mixer assembly 22. The air-exhaust mixer assembly 22 further includes a mixer exhaust portion 61 that defines a mixer exhaust cavity 62. The mixer exhaust cavity 62 is fluidly coupled to both the inner passage 43 and the outer passage 45 of the mixer. In the illustrated embodiment, the connection elbow 35 and the mixer exhaust portion 61 have an elbow shape. It should be appreciated that the connection elbow 35 and the mixer exhaust portion 61 can be shaped differently in order to accommodate the particular plumbing requirements for a project. The mixer exhaust portion 61 further includes bolt holes 63 for securing the mixer assembly 22 to the mixed air-exhaust gas conduit 23 and an exhaust seal 64 for sealing the exhaust portion 61 to the mixed air-exhaust gas conduit 23. In one particular embodiment, the mixed air-exhaust gas conduit 23 includes a manifold for an engine.

The operation of the mixer assembly 22 will now be described in reference to FIGS. 2–4. In FIGS. 2–4, arrows A represent the flow path of intake air and arrows E represent the flow path of exhaust gas. As illustrated, air is supplied from the air connection elbow 35, and the air flows in direction A through air intake 30 into the inner passage 43. Exhaust gas from the EGR valve 27 is received in the exhaust gas intake 31. From there, the exhaust flows in direction E into the outer passage 45 and travels around the air intake portion 30. As the air passes through the inner mixer channels 50, the air is directed to expand in the radially outward direction O. In contrast, as the exhaust gas travels along the outer channels 51, the outer channels 51 direct the exhaust gas to expand in the radially inward direction I. Upon exiting the mixer 32, the two gases continue to radially expand in opposite directions so as to mix within the mixing cavity 62. By having the two gasses expand in opposite radial directions, ensures that the two gasses are completely mixed over a relatively short distance in the mixing cavity 62. The corrugated cylindrical shape of the mixer 32 ensures that the mixer 32 occupies a relatively small space. After mixing, the mixed gasses are then exhausted through exhaust portion 61 in direction M. This mixed gas is then sent through mixed air-exhaust gas conduit 23 to the engine 24. It should be appreciated that assembly 22 could be modified so that the air would flow in the outer passage 45 and the exhaust gas would flow in the inner passage 43.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. An air-exhaust mixer assembly, comprising:

an air intake to supply air;

an exhaust gas intake to supply exhaust gas; and a mixer fluidly coupled to said air intake and said exhaust gas intake, said mixer having an inner passage and an outer passage defined therein along a longitudinal axis, wherein said inner passage and said outer passage are constructed and arranged to deliver said air and said exhaust gas ready for mixing by expanding said air and said exhaust gas in radially opposite directions with respect to said longitudinal axis.

2. The assembly of claim 1, wherein said inner passage is fluidly coupled to said air intake and said outer passage is fluidly coupled to said exhaust gas intake.

3. The assembly of claim 2, wherein said inner passage is adapted to expand said air in a radially outward direction and said outer passage is adapted to expand said exhaust gas in a radially inward direction.

4. The assembly of claim 1, wherein said radially opposite directions include a radially inward direction with respect to said longitudinal axis and a radially outward direction with respect to said longitudinal axis.

5. The assembly of claim 1, wherein said mixer has corrugated walls that define said inner passage.

6. The assembly of claim 5, wherein said corrugated walls define inner channels in said inner passage.

7. The assembly of claim 6, wherein said mixer has an upstream portion and a downstream portion, said inner channels radially expand from said upstream portion to said downstream portion.

8. The assembly of claim 5, wherein said mixer includes a housing provided around said corrugated walls, said housing, said air intake and said corrugated walls define said outer passage, and said corrugated walls define outer channels for said outer passage.

9. The assembly of claim 8, wherein said mixer has an upstream portion and a downstream portion, said outer channels radially expand from said upstream portion to said downstream portion.

10. The assembly of claim 5, wherein said corrugated walls have flat end portions.

11. The assembly of claim 1, wherein said air intake has a frusta-conical shape.

12. The assembly of claim 1, further comprising:

an intake connection elbow fluidly coupled to said air intake; and a seal provided between said connection elbow and said air intake.

13. The assembly of claim 12, further comprising at least one cap screw fastening said intake connection elbow to said air intake.

14. The assembly of claim 1, further comprising a housing provided around said mixer, said housing having a mixer exhaust cavity fluidly coupled to said outer passage and said inner passage.

15. The assembly of claim 1, wherein said mixer has a corrugated cylindrical portion that defines inner channels and outer channels, said inner channels are adapted to expand said intake air in a radially outward direction, and said outer channels are adapted to expand said exhaust gas in a radially inward direction.

16. The assembly of claim 1, further comprising:

an intake connection elbow fluidly coupled to said air intake;

a seal provided between said connection elbow and said air intake;

at least one cap screw fastening said intake connection elbow to said air intake;

wherein said inner passage is fluidly coupled to said air intake and said outer passage is fluidly coupled to said exhaust gas intake;

wherein said inner passage is adapted to expand said air in a radially outward direction and said outer passage is adapted to expand said exhaust gas in a radially inward direction;

wherein said mixer has corrugated walls that define said inner passage, said corrugated walls define inner channels in said inner passage, said corrugated walls have flat end portions;

wherein said mixer has an upstream portion and a downstream portion, said inner channels radially expand from said upstream portion to said downstream portion;

wherein said mixer includes a housing provided around said corrugated walls, said housing, said air intake and said corrugated walls define said outer passage, said corrugated walls define outer channels for said outer passage, said outer channels radially expand from said upstream portion to said downstream portion, said housing has a mixer exhaust cavity fluidly coupled to said outer passage and said inner passage; and wherein said air intake has a frusta-conical shape.

17. An apparatus, comprising:

an engine having an air intake for supplying air to said engine and an exhaust for exhausting exhaust gas from said engine;

a mixer fluidly coupled to said air intake and said exhaust, said mixer having an inner passage and an outer passage defined therein along a longitudinal axis, wherein said inner passage and said outer passage are constructed and arranged to deliver said air and at least a portion of said exhaust gas ready for mixing by expanding said air and said portion of said exhaust gas in radially opposite directions with respect to said longitudinal axis.

18. The apparatus of claim 17, wherein said mixer has a corrugated cylindrical portion that defines inner channels and outer channels, said inner channels are adapted to expand said intake air in a radially outward direction, and said outer channels are adapted to expand said exhaust gas in a radially inward direction.

19. The apparatus of claim 17, wherein said engine includes an internal combustion engine.

20. The apparatus of claim 17, further comprising an exhaust gas recirculation valve coupled to said exhaust for recirculating said portion of said exhaust gas.

* * * * *